US006652345B1

(12) United States Patent
Lin

(10) Patent No.: US 6,652,345 B1
(45) Date of Patent: Nov. 25, 2003

(54) YO-YO BUBBLE TOY

(76) Inventor: Mon-Sheng Lin, 5th Floor, No. 4, Lane 7, Pao Kao Road., Hsintien, Taipei Hsien (TW)

( * ) Notice: Subject to any disclaimer, the term of this patent is extended or adjusted under 35 U.S.C. 154(b) by 0 days.

(21) Appl. No.: 10/372,935

(22) Filed: Feb. 26, 2003

(51) Int. Cl.[7] ..... A63H 33/28
(52) U.S. Cl. ..... 446/15; 446/247
(58) Field of Search ..... 446/15–21, 247, 446/248, 250

(56) References Cited

U.S. PATENT DOCUMENTS 2,556,756 A * 6/1951 Gray
3,745,693 A * 7/1973 La Fata et al.

* cited by examiner

*Primary Examiner*—Jacob K. Ackun
*Assistant Examiner*—Jamila Williams
(74) *Attorney, Agent, or Firm*—Troxell Law Office PLLC

(57) ABSTRACT

A yo-yo bubble toy mainly comprises a bubble container, a symmetrical shell, a fluid tube and a pulling rope where the bubble container is integrally formed with huge hollow chamber inside. The container has a projected mouth to accept the bubble fluid supplied by the fluid tube and an axially extended shaft tube. The symmetrical shell is in cap form having an opening linked to a bottom cover. The bottom cover has an upward extended connector to accept the insert of shaft tube projected out from the container. The outer wall of the shaft tube has a plurality of lock ring, which can be caught in the lock grooves in same number of the lock rings on the connector so to secure the container to the symmetrical shell, which expands the capacity of the bubble container and allow the fluid tube to penetrate deeply into bottom.

3 Claims, 5 Drawing Sheets

YO-YO BUBBLE TOY

FIELD OF THE INVENTION

This invention relates to the composite yo-yo bubble toy, in particular, the hollow center of the yo-yo ball is fully utilized to be a value-added toy.

BACKGROUND OF THE INVENTION

The prior art of yo-yo ball embraces many ways of playing dependent on how skillful the player is. However, a single performance the yo-yo ball plays with can no longer satisfy the curiosity of smart children, either it lack the sharp competitive edge in the toy market.

SUMMARY OF THE INVENTION

The main object of this invention is to provide a yo-yo bubble toy in which the yo-yo ball is fully used as the bubble container to be filled with bubble fluid. The bubble container has an extended shaft tube used as a spindle to wind up with the pulling rope. The extended length of the shaft tube can house the full length of the fluid tube so the limit space within the bubble container is used to the maximum advantage.

Another object of the invention is to create more fun for children by combining the yo-yo ball with the bubble blowing function.

DETAILED DESCRIPTION OF THE PREFERRED EMBODIMENT

Figure 1:
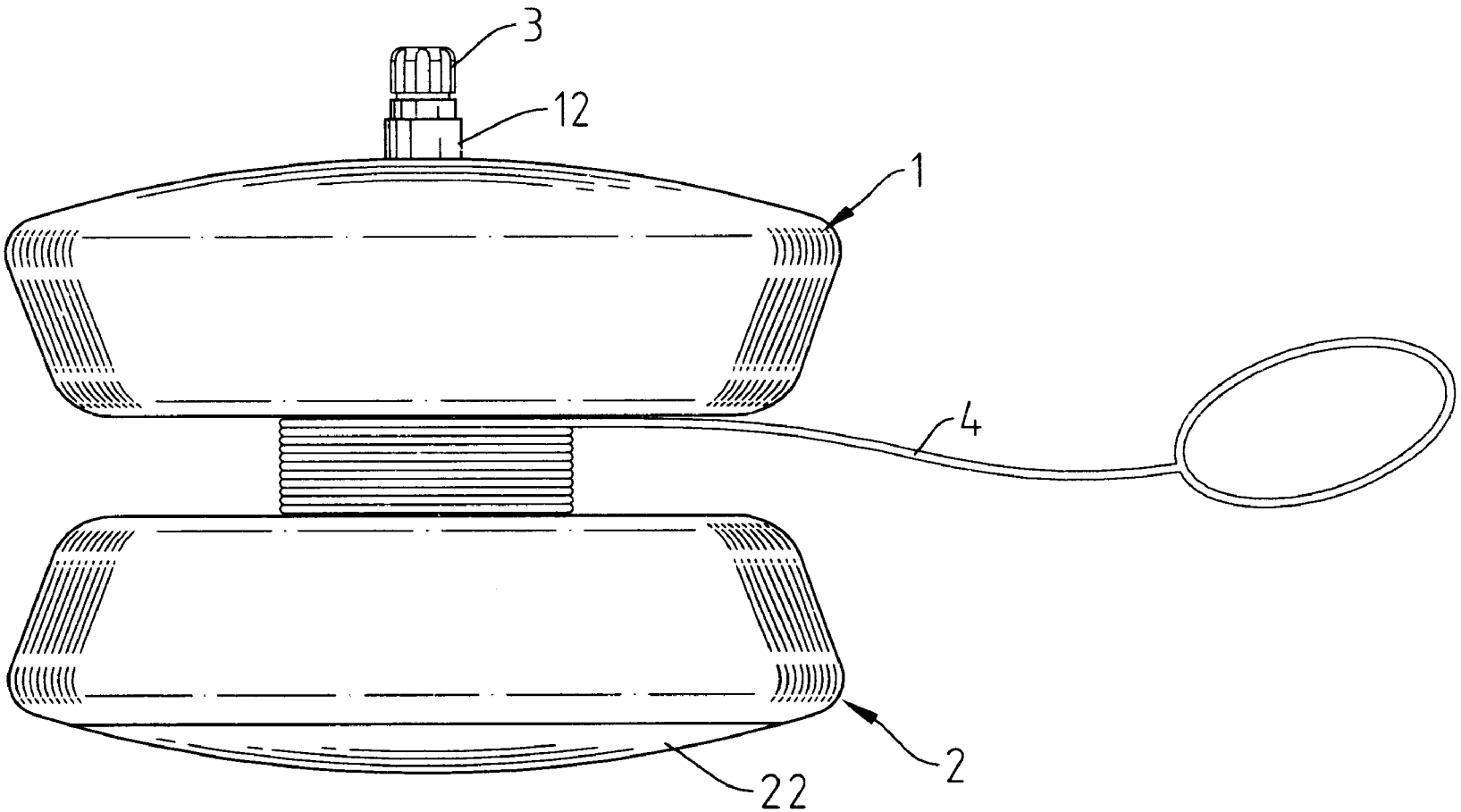
FIG. 1 is a stereo appearance of the yo-yo bubble toy of this invention.
Figure 2:
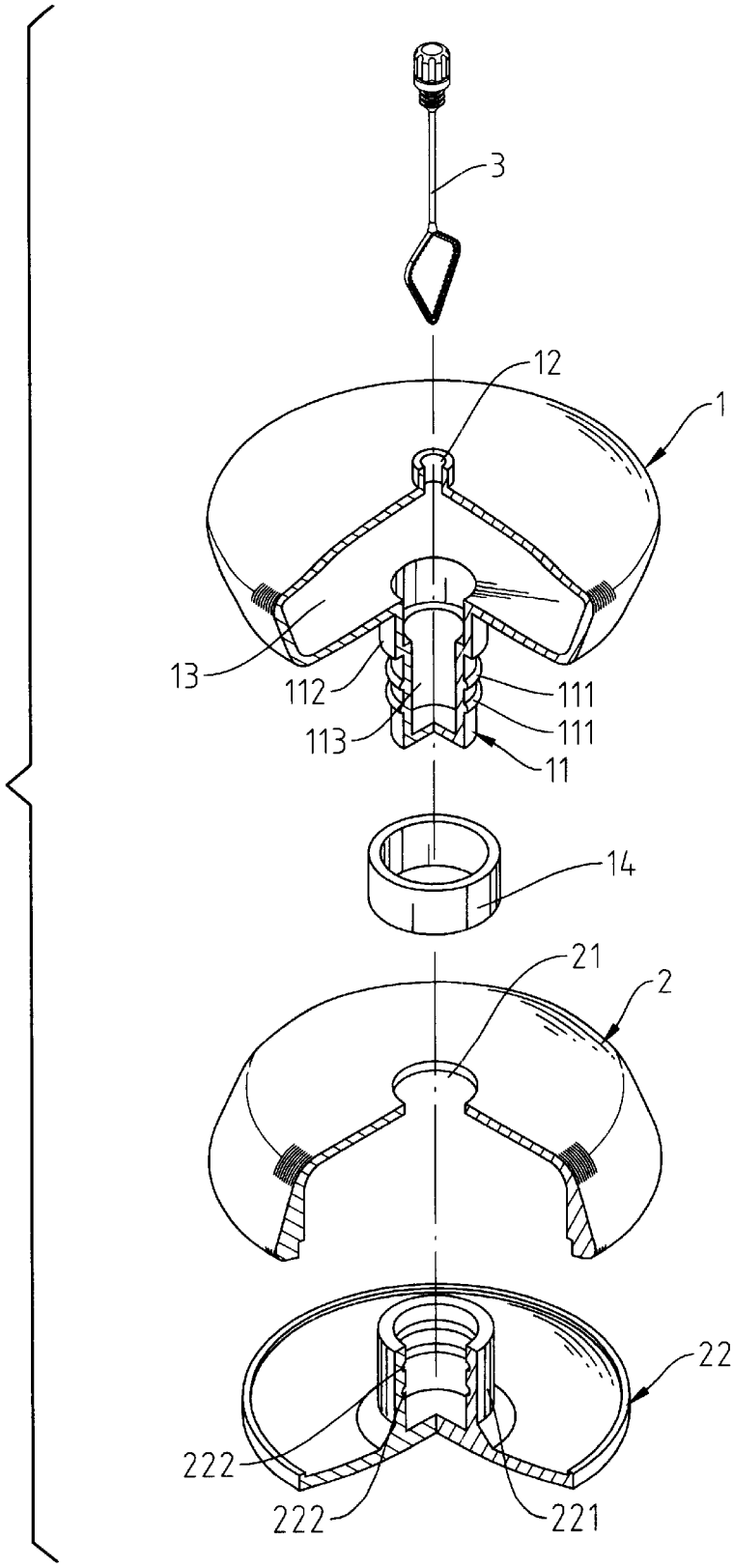
FIG. 2 is a disassembly of the yo-yo bubble toy of this invention.
Figure 3:
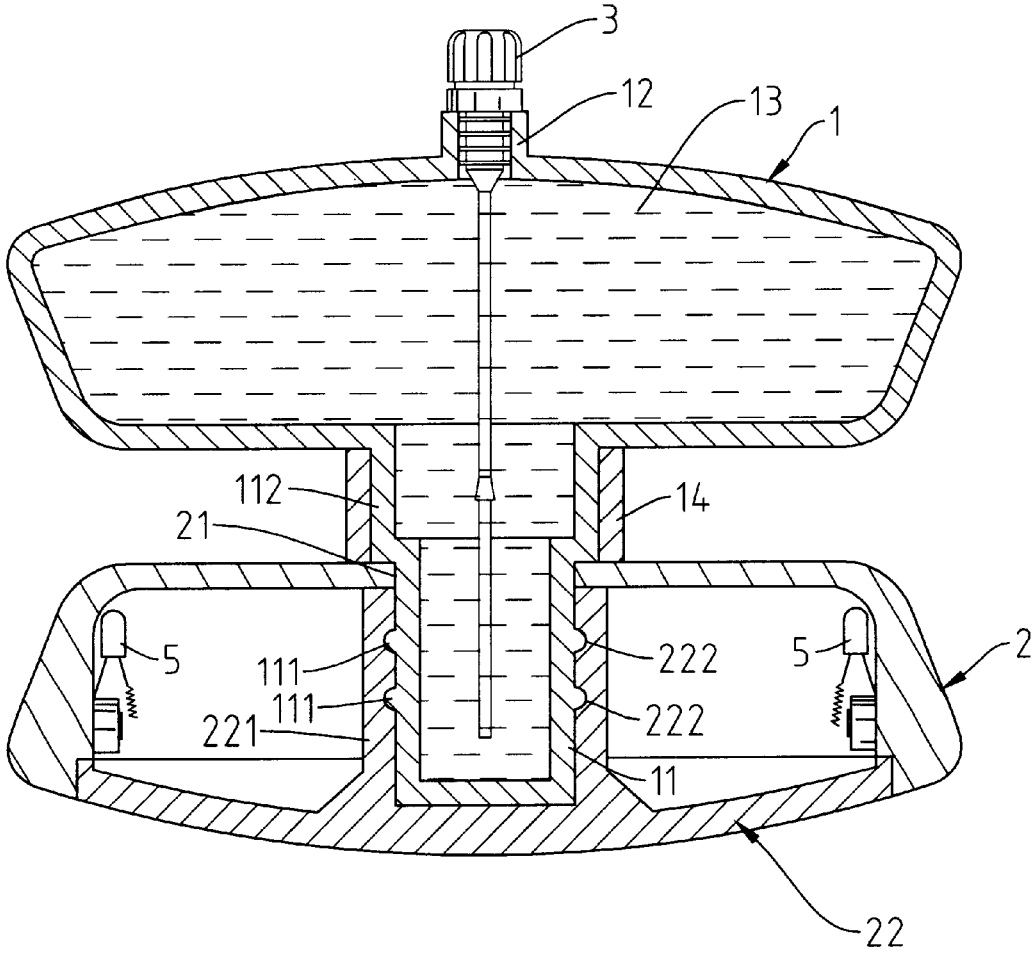
FIG. 3 is a cross-section of the yo-yo bubble toy of this invention.

As shown in FIGS. 1 through 3, the yo-yo bubble toy of the invention is a combination of the yo-yo ball and the bubble toy, mainly comprising a bubble container 1, a symmetrical shell 2, a fluid tube 3 and a pulling rope 4, in which the bubble container 1 and the symmetrical shell 2 are similar shape and size but disposed oppositely. The bubble container 1 is integrally formed having a huge hollow chamber 13 inside to be filled with bubble fluid and an upward mouth 12 to receive the fluid tube 3. The bubble container 1 has a downward extended shaft tube 11 with a closed bottom. The hollow space 113 formed in the shaft tube directly connects to the bubble chamber 13. The shaft tube 11 further penetrates the sleeve 14 and links to the symmetrical shell 2. The sleeve 14 provides space to be wound with the pulling rope 4. The outer wall of the shaft tube 11 outfits with a plurality of lock ring 111.

The symmetrical shell 2 is in the cap cover shape, having aperture 21 permitting the shaft tube 11 to pass through. The wall of the aperture 21 connects to the bottom cover 22. The bottom cover 22 has an inward connector 221 to receive the shaft tube 11 from the bubble container 1. The shaft tube has a plurality of lock rings 111 to be caught in the lock grooves 22 on the connector 221 so as to secure the bubble container 1 and the symmetrical shell 2 together.

Figure 5:
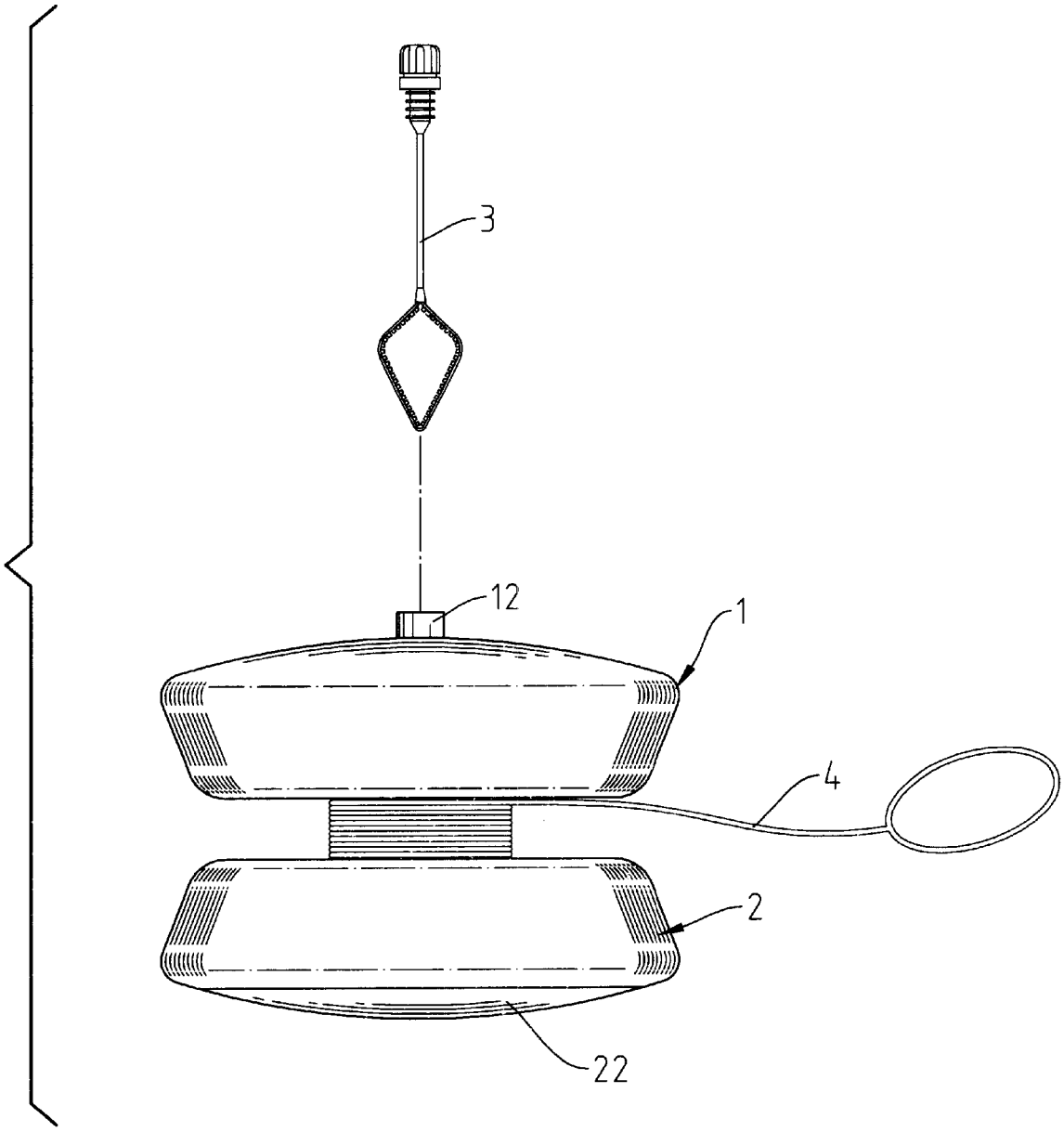
FIG. 5 shows a yo-yo bubble toy of this invention in operation.

Please refer to FIGS. 3 and 5, the shaft tube 11 extends deeply into the symmetrical shell 2 so as to enlarge the volume of the bubble container 1 and permits the fluid tube 3 being placed in the shaft tube 111. Besides working as house to accept the fluid tube 3, the shaft tube 11 serves as a connection for the bubble container 1 and the symmetrical shell 2 to constitute a complete yo-yo ball. The shaft tube 11 is also enveloped with a sleeve 14, which serves a spindle for winding the pulling rope 4.

Figure 4:
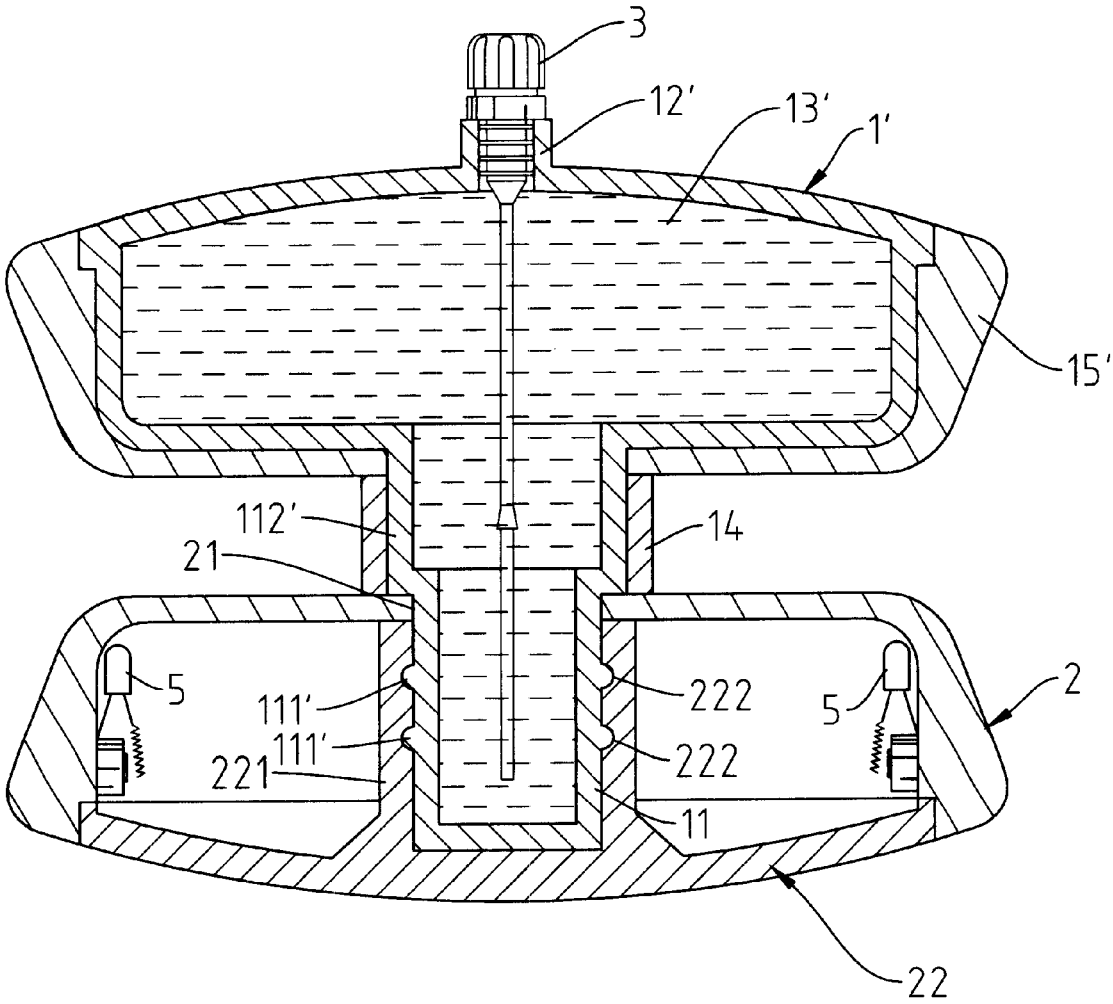
FIG. 4 is another embodiment of the yo-yo bubble toy of this invention.

Please refer to FIGS. 3 and 4, an illuminator 5 is installed in the symmetrical shell 2 of the yo-yo bubble toy. While the symmetrical is whipping, the centrifugal force renders conductivity and the illuminator 5 will generate colorful lights, which serves as an additional fun or interest of the yo-yo bubble toy. In order to reinforce the strength of the bubble container 1' as shown in FIG. 4, the bubble container 1' is slightly reduced in size to be wrapped an outer casing 15' on its outer rim to avoid the indentation and deformation in collision. The bubble container 1' has shaft tube 11', mouth 12' and bubble chamber 13'. The shaft tube 11' has lock ring 111' and 112' just entirely identical to embodiments as illustrated in FIGS. 1 through 3.

As stated above, it is apparent that this yo-yo bubble toy is novel invention, not appear in the market before. It owns great advantages and expected practical value, justified as new design for granting patent.

What is claimed is:

1. A yo-yo bubble toy, at least comprising a bubble container, a symmetrical shell, a fluid tube and a pulling rope, wherein said pulling rope is wound in a central part formed between said bubble container and said symmetrical shell, characterized in that:

said bubble container is integrally formed with a huge hollow chamber to be filled with bubble fluid supplied by said fluid tube, said bubble container has an inward shaft tube linked into said symmetrical shell, said shaft tube is enclosed with a sleeve;

said symmetrical shell is in a form of a cap cover, having an aperture to pass said shaft tube to a bottom cover, said bottom cover has an inward projected connector to receive and lock up said shaft tube; and said shaft tube serves as an extension of the bubble container, as a connector to link said bubble container and said symmetrical shell together and as accommodation to receive said fluid tube.

2. The yo-yo bubble toy of claim 1, wherein said shaft tube has a hollow bottom with inside connected to a bubble chamber of said bubble container, said bubble chamber is an expansion of said bubble container and gives more space to receive said fluid tube.

3. The yo-yo bubble toy of claim 1, wherein an outer wall of said shaft tube has a plurality of lock rings to be fitted into lock groves on said connector of said symmetrical shell so said bubble container and the symmetrical shell are linked together.

* * * * *